US007458871B2

(12) United States Patent
Kosaka et al.

(10) Patent No.: US 7,458,871 B2
(45) Date of Patent: Dec. 2, 2008

(54) GAS DISCHARGE PANEL PRODUCTION METHOD

(75) Inventors: Tadayoshi Kosaka, Kawasaki (JP); Souichirou Hidaka, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 477 days.

(21) Appl. No.: 11/257,109

(22) Filed: Oct. 25, 2005

(65) Prior Publication Data

US 2006/0043897 A1 Mar. 2, 2006

Related U.S. Application Data

(62) Division of application No. 10/653,228, filed on Sep. 3, 2003, now Pat. No. 6,984,937.

(30) Foreign Application Priority Data

Oct. 31, 2002 (JP) ..... 2002-318120

(51) Int. Cl.
*H01J 9/00* (2006.01)
*H01J 17/49* (2006.01)

(52) U.S. Cl. ..... 445/24; 313/587

(58) Field of Classification Search ..... 313/582–587; 445/24–25

See application file for complete search history.

(56) References Cited

U.S. PATENT DOCUMENTS

| | | | | |
|---|---|---|---|---|
| 6,437,506 | B1 | 8/2002 | Mitamura et al. | 313/586 |
| 6,821,616 | B1 | 11/2004 | Sakurai et al. | 428/332 |
| 7,070,471 | B2 * | 7/2006 | Shiokawa et al. | 445/24 |
| 2002/0008817 | A1 * | 1/2002 | Ito et al. | 349/122 |
| 2002/0195938 | A1 | 12/2002 | Kawamura | 313/582 |
| 2003/0030377 | A1 | 2/2003 | Hirano et al. | 313/587 |

FOREIGN PATENT DOCUMENTS

| | | |
|---|---|---|
| EP | 1164620 | 12/2001 |
| JP | HEI 3-230447 | 10/1991 |
| JP | HEI 9-92161 | 4/1997 |
| JP | WO0175926 A1 * | 10/2001 |

OTHER PUBLICATIONS

Patent Abstracts of Japan, Publication No. 08255562, published Oct. 1, 1996, English language.
Patent Abstracts of Japan, Publication No. 2001035382, published Feb. 9, 2001, English language.
Lee W. T., et al., "Studies on a LaF3-Coated Mg0 Protecting Layer in AC-Plasma Display Panels", Database Compendex, XP-002370964, published Jan. 10, 1996.

* cited by examiner

*Primary Examiner*—Nimeshkumar D Patel
*Assistant Examiner*—Anne M Hines
(74) *Attorney, Agent, or Firm*—Staas & Halsey LLP

(57) ABSTRACT

According to the present invention, there is provided a gas discharge panel having at least a protective film containing a driving voltage-reducing compound.

3 Claims, 5 Drawing Sheets

GAS DISCHARGE PANEL PRODUCTION METHOD

This application is a divisional of application Ser. No. 10/653,228, filed Sep. 3, 2003, now U.S. Pat. No. 6,984,937 which is incorporated herein by reference.

CROSS-REFERENCE TO RELATED APPLICATION

This application is related to Japanese application No. 2002-318120 filed on Oct. 31, 2002, whose priority is claimed under 35 USC § 119, the disclosure of which is incorporated by reference in its entirety.

BACKGROUND OF THE INVENTION

1. Field of the Invention

The present invention relates to a gas discharge panel and a production method thereof. More specifically, the present invention relates to a method of producing a gas discharge panel for a plasma display panel (PDP) or a plasma addressing liquid crystal device (PALC), for example. The gas discharge panel according to the present invention is desirably used for household TVs, computer monitors, as well as large-screen displays for displaying information installed at stations, airports, stock exchanges, factories, schools and the like.

2. Description of the Prior Art

Conventionally, plasma display panels (PDP) and plasma addressing liquid crystal devices (PALC) are known as gas discharge panels. Among these gas discharge panels, PDP is characterized by large size and small thickness, and is one of the largest selling display apparatuses at the present time.

Now structure of a standard PDP will be illustrated using FIG. 1 on the basis of a PDP with 42-inch wide screen manufactured by Fujitsu which is commercially available at this time. FIG. 1 is a schematic perspective view illustrating the internal structure of the PDP.

A PDP 100 depicted in FIG. 1 generally consists of a front side substrate and a back side substrate.

First, the front side substrate generally consists of a display electrode in the form of stripe of plural lines formed on a glass substrate 11, a dielectric layer 17 formed so as to cover the display electrode, and a protective film (for example, MgO layer) 18 formed on the dielectric layer 17 and exposed to a discharge space.

The display electrode consists of a transparent electrode film 41 in the form of stripe and a bus electrode 42 laminated on the transparent electrode film 41. The bus electrode 42 has in the for of stripe and is narrower in width than the transparent electrode film.

Next, the back side substrate generally consists of a plurality of address electrodes A in the form of stripe formed on a glass substrate 21, a plurality of barrier ribs 29 in the form of stripe formed on the glass substrate 21 between neighboring address electrodes, and a phosphor layer 28 formed between barrier ribs 29 including the wall surfaces. As the phosphor material for use in the phosphor layer, $(Y, Gd)BO_3$:Eu for red, $Zn_2SiO_4$:Mn for green, and $BaMgAl_{10}O_{17}$:Eu for blue are exemplified.

Then the abovementioned front side substrate and back side substrate are brought into opposite with each other with their inner faces opposing so that the display electrode and the address electrode intersect at right angles, and a space surrounded by the-barrier ribs 29 is filled with a discharge gas (for example, Ne—Xe gas), to thereby form the PDP 100. In FIG. 1, R, G and B respectively represent unit light-emitting areas of red, green and blue, and constitute pixels by laterally arranged RGB.

A general manufacturing process of PDP will now be explained using the process flow shown in FIG. 2.

First, the front side substrate manufacturing process comprises the steps of: forming the transparent electrode film on the substrate, forming the bus electrode, forming the dielectric layer, and forming the protective film. On the other hand, the back side substrate manufacturing process comprises the steps of: forming the address electrode on the substrate, forming the barrier rib, and forming the phosphor layer. The front side substrate and the back side substrate thus obtained through the front side substrate manufacturing process and the back side substrate manufacturing process are then subjected to a panel assembling step, intra-panel evacuation step, and intra-panel discharge gas introducing step, to complete the PDP.

Description of the general structure of PDP is found, for example, in Japanese Unexamined Patent Publication No. HEI 9(1997)-92161, Japanese Unexamined Patent Publication No. HEI 3(1991)-230447.

Since conventionally PDP requires high driving voltages ranging from 150 V to 250 V, the PDP has problems that it requires an expensive high pressure resistant driving circuit, electric power consumption is large, and electromagnetic wave is considerably generated. Therefore, it has been requested to develop a protective film which realizes high secondary electron discharge rate (secondary electron discharge coefficient) and low driving voltage.

SUMMARY OF THE INVENTION

In order to solve the above-mentioned problem, researches have been made for a material which will be an alternative of MgO usually used for a protective film, however, materials with sufficient properties have not been discovered yet. As a result of consideration, the inventors of the present invention found that by modifying MgO, it is possible to obtain a PDP having a lower driving voltage than the case of using non-modified MgO, and accomplished the present invention.

Therefore, according to the present invention, there is provided a gas discharge panel having at least a protective film containing a driving voltage-reducing compound.

Furthermore, according to the present invention, there is provided a method of producing a gas discharge panel comprising the step of forming a protective film containing a driving voltage-reducing compound by exposing a protective film to an atmosphere of driving voltage-reducing compound directly after forming the protective film.

Also, according to the present invention, there is provided a method of producing a gas discharge panel comprising the step of exposing a protective film to an atmosphere of driving voltage-reducing compound after irradiating the protective film with vacuum UV rays, thereby forming a protective film containing a driving voltage-reducing compound.

Further, according to the present invention, there is also provided a method of producing a gas discharge panel comprising the steps of heating a protective film to 300° C. or more, cooling the same to atmospheric temperature, and then exposing the protective film to an atmosphere of driving voltage-reducing compound, thereby forming a protective film containing a driving voltage-reducing compound.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

Figure 1:
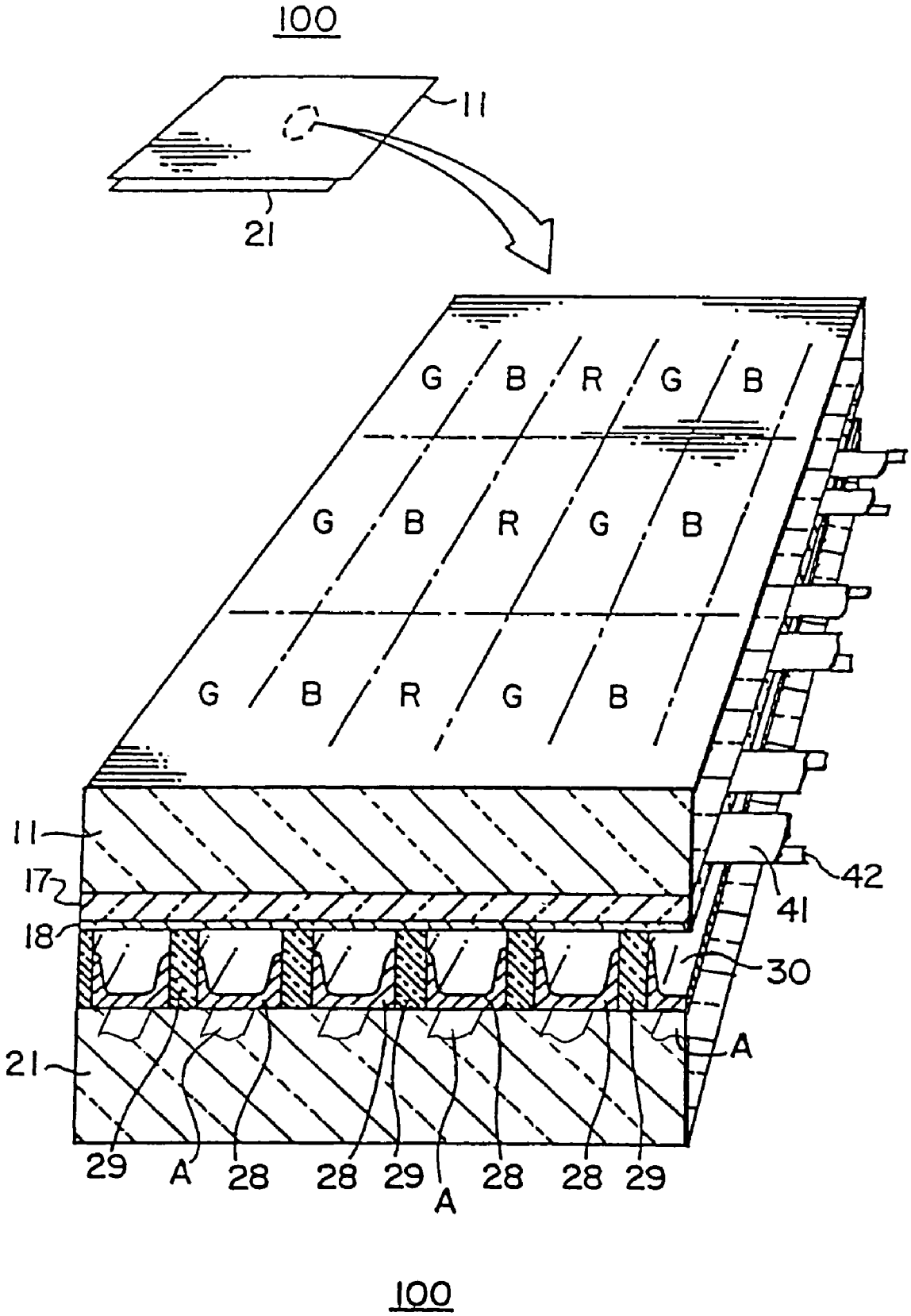
FIG. 1 is a schematic perspective view of a structure of a PDP.

A gas discharge panel of the present invention has at least a protective film containing a driving voltage-reducing compound. Herein, the term "gas discharge panel" refers, but not limited, to any panels which achieve display using gas discharge, for example PDP, PALC and the like.

The driving voltage-reducing compound is not particularly limited insofar as it can reduce driving voltage by being contained in the protective film.

Examples of the driving voltage-reducing compounds include inorganic compounds such as hydrogen and carbon monoxide; hydrocarbons such as methane, ethane, propane, butane, ethylene, acetylene, vinylacetylene, methoxyacetylene, ethoxyacetylene, propylene, propine, allene, 2-methylpropene, isobutane, 1-butene, 2-butene, 1,3-butadiene, 1,2-butadiene, 1,3-butadiyne, bicyclo[1.1.0]-butane, 1-butyne, 2-butyne, cyclopropane, cyclobutane and cyclobutene; ethers such as dimethyl ether, diethyl ether, ethylmethyl ether, methylvinyl ether, divinyl ether, diethylene glycol monobutyl ether, 1,4-dioxine, diethylene glycol monobutyl ether acetate and furan; alcohols such as methanol, ethanol, 1-propanol, 2-propanol, 1-butanol, 2-butanol, t-butyl alcohol, isobutyl alcohol, 2-propine-1-ol, 2-butynal, α-terpineol; aldehydes such as formaldehyde, acrylaldehyde, malealdehyde and crotonaldehyde; ketones such as ketene, diketene, dimethylketene, 2-butanone, 3-butyne-2-on and cyclobutanone; and organic acids such as 2-butynic acid and crotonic acid.

Among the above driving voltage-reducing compounds, 1-propanol, diethylene glycol monobutyl ether acetate, methane, α-terpineol and 1-butanol are preferably used.

The content ratio of the driving voltage-reducing compound is preferably, but not particularly limited insofar as it can reduce the driving voltage, in the range of 0.1 to 2.0% by weight with respect to the protective film. Content ratios of less than 0.1% by weight are not preferred since sufficient effect cannot be achieved, while the content ratios of more than 2.0% by weight are not preferred because the compound may emit gas during electric discharge, to hinder the electric discharge. More preferred content ratio is in the range of 0.6 to 1.0% by weight.

Although the mechanism by which the above compound reduces the driving voltage is not clearly known, it is conceived that by containing the above compound in the protective film, the conductive state of the protective film or the discharge rate of secondary electron changes, which results in reduction of driving voltage. More specifically, by containing the above compound, it is possible to reduce the driving voltage by 10V or more (for example, 10 to 20 V) compared to the case where the compound is not contained.

The protective film is usually formed of an MgO film, however, an SrO film may also be used. For forming the protective film, any known methods can be used without any limitation. For example, physical deposition methods such as vapor deposition, and applying and baking methods and the like can be used. The thickness of the protective film is preferably in the range of 0.5 to 1.5 μm.

As one example of gas discharge panel to which the protective film of the present invention is applicable, a three electrode AC-type surface discharge PDP shown in FIG. 1 will be described below. It is to be noted that the following examples are provided only for illustrative purpose and not limiting the present invention.

A PDP 100 shown in FIG. 1 consists of a front side substrate and a back side substrate.

First, the front side substrate generally consists of a display electrode in the form of stripe of plural lines formed on a glass substrate 11, a dielectric layer 17 formed so as to cover the display electrode, and a protective film 18 formed on the dielectric layer 17 and exposed to a discharge space.

The present invention is applicable to the above protective film 18.

The display electrode consists of a transparent electrode film 41 in the form of stripe or dots per discharge cell unit, and a bus electrode 42 laminated on the transparent electrode film 41 for reducing the resistance of the transparent electrode film. The bus electrode 42 has in the form of stripe and is narrower in width than that of the transparent electrode film.

As for the method of forming the transparent electrode film 41, a forming method which involves application of a paste containing an organic compound of a metal constituting the transparent electrode film and baking of the same is exemplified.

Next, the back side substrate generally consists of a plurality of address electrodes A in the form of stripe formed on the glass substrate 21, a plurality of barrier ribs 29 in the form of stripe formed on the glass substrate 21 between neighboring address electrodes, and a phosphor layer 28 of barrier rib formed between barrier ribs 29 including the wall faces.

The barrier rib 29 can be formed by applying a paste containing low-melting glass and a binder on the dielectric layer 27 so as to form a film, baking the same, and cutting the same via a mask in shape of barrier rib by means of a sandblast method. In the case where a photosensitive resin is used for the binder, it may be formed by baking after exposure and development using a mask of a predetermined shape.

The phosphor layer 28 can be formed by applying a paste in which a granular phosphor material is dispersed in a solution dissolving the binder, between the barrier ribs 29, and baking the same in an inert atmosphere. It is to be noted that since the driving voltage-reducing compound includes a reductive compound, the compound may reduce the phosphor material to deteriorate it during production process and driving. For this reason, it is preferred to use an anti-reducing substance for the phosphor material. As such a phosphor material, $BaAl_{12}O_{19}$:Mn (green), $Y_2SiO_5$:Ce (blue) and the like can be used. The dielectric layer may be formed on the glass substrate 21 so as to cover the address electrodes A, and the barrier rib and the phosphor layer may be formed on the dielectric layer.

The above front side substrate and the back side substrate are brought into opposite with each other with their inner faces opposing so that the display electrode and the address electrode intersect at right angles, and a space surrounded by the barrier ribs 29 is filled with a discharge gas, to thereby form the PDP 100.

The PDP which may be used in the present method is not limited to the PDP having the above structure shown in FIG. 1, but any PDP can be used insofar as it has a protective film, such as of opposite discharge type, or transparent type in which a phosphor layer is arranged on the front side substrate, as well as a PDP having a two electrode structure. Additionally, the barrier rib may be of a mesh form.

Next, explanation will be made on the method for containing the protective film in the driving voltage-reducing compound. In the present invention, the following three methods are used.

(1) A method in which a protective film is exposed to an atmosphere of driving voltage-reducing compound directly after formation of the protective film.

(2) A method in which a protective film is exposed to an atmosphere of driving voltage-reducing compound after the protective film is subjected to vacuum UV irradiation.

(3) A method in which after heating a protective film to 300° C. or more, and cooling the same to atmospheric temperature (about 25° C.), the protective film is exposed to an atmosphere of driving voltage-reducing compound.

It is known that materials usually used for the protective film gradually absorb carbon dioxide in the air, so that the active part thereof is reduced (for example, MgO becomes $MgCO_3$). Any of the above methods (1) to (3) are based on the fact that the driving voltage-reducing compound is contained before the active part reduces.

In the method (1), the expression "directly after" refers to the period during which the active part of the protective film still exists.

In the method (2), it is possible to activate the protective film by irradiating with vacuum UV rays. The irradiation is preferably performed under the conditions: vacuum UV rays having a wavelength of 120 to 300 nm, 0.5 to 50 mW/cm$^3$ in energy, for 5 to 10 minutes. The shorter the wavelength, the better the efficiency.

In the method (3), it is possible to activate the protective film by heating the protective film. Furthermore, by exposing the protective film to the atmosphere of driving voltage-reducing compound after cooling the same to atmospheric temperature, it is possible to efficiently contain the compound in the protective film. If the protective film is exposed to the atmosphere of the compound without cooled, it is impossible to efficiently contain the compound because the compound is highly active.

In the methods.(1) to (3), the time for exposing to the atmosphere of driving voltage-reducing compound is usually from 10 minutes to 1 hour depending on the compound being used.

Japanese Unexamined Patent Publication No. HEI 9(1997)-92161 discloses, for improving the life, a method of mixing 0.0001 to 1% of reductive gas in the discharge gas. Although this method improves the like of PDP by removing oxygen remaining in the discharge space, there is no description with regard to modification of the protective film, and hence is different from the present invention in this point.

Also Japanese Unexamined Patent Publication No. HEI 3(1991)-230447 discloses a method of reducing the aging time by removing excess oxygen in the protective film by input/output of reductive gas, and thereby stabilizing the oxidation state of the protective film. Practically, input/output of reductive gas is conducted at high temperature of 360° C., and in such high temperature condition, the reductive gas will not adsorb to the protective film. The above patent is different in this point from the present invention.

EXAMPLE

The present invention will now be explained specifically by way of examples, however, it is to be understood that the present invention is not limited to these examples.

Example 1

Figure 2:
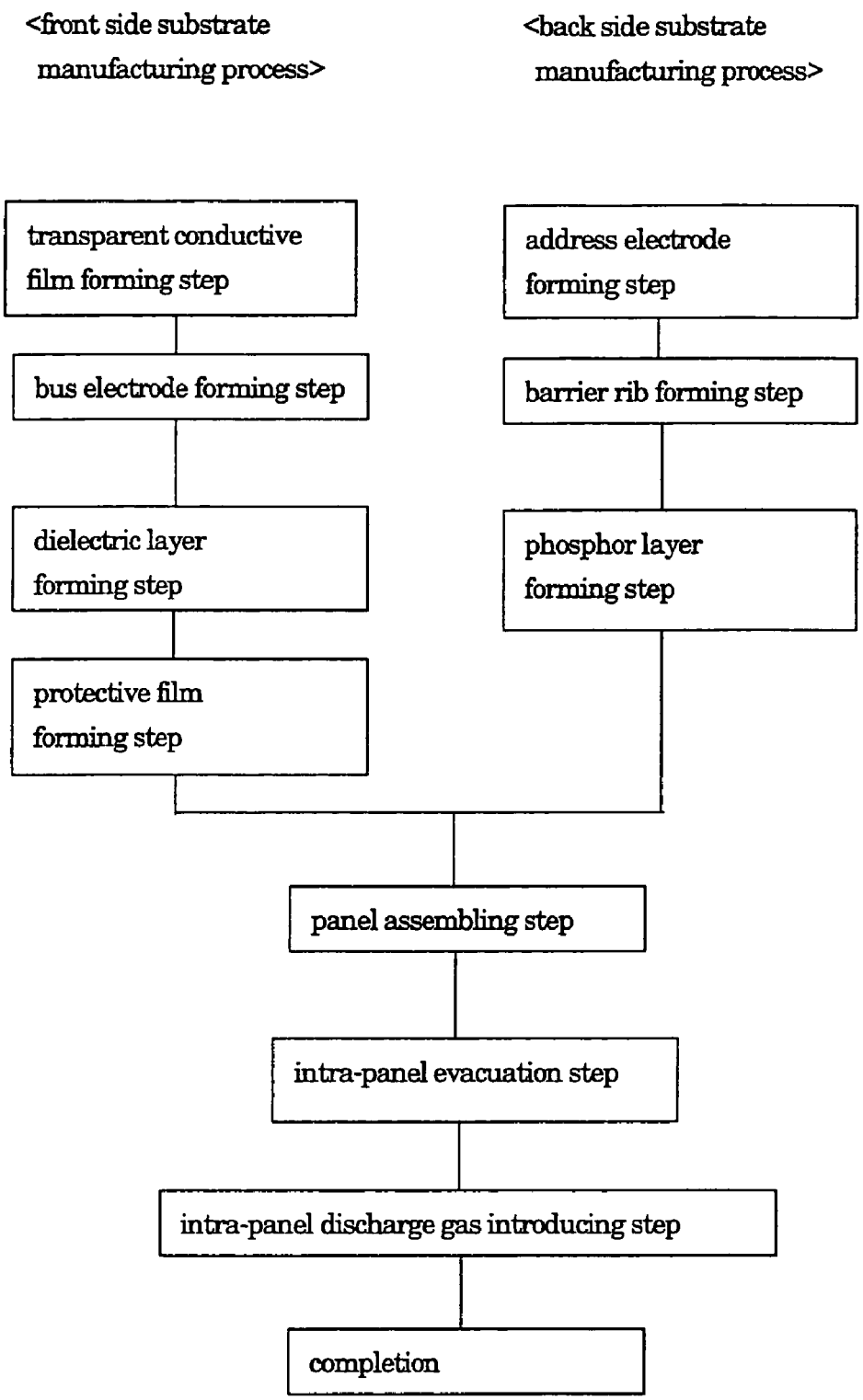
Fig. 2 prior art
FIG. 2 is a process flow of a conventional PDP.
Figure 3:
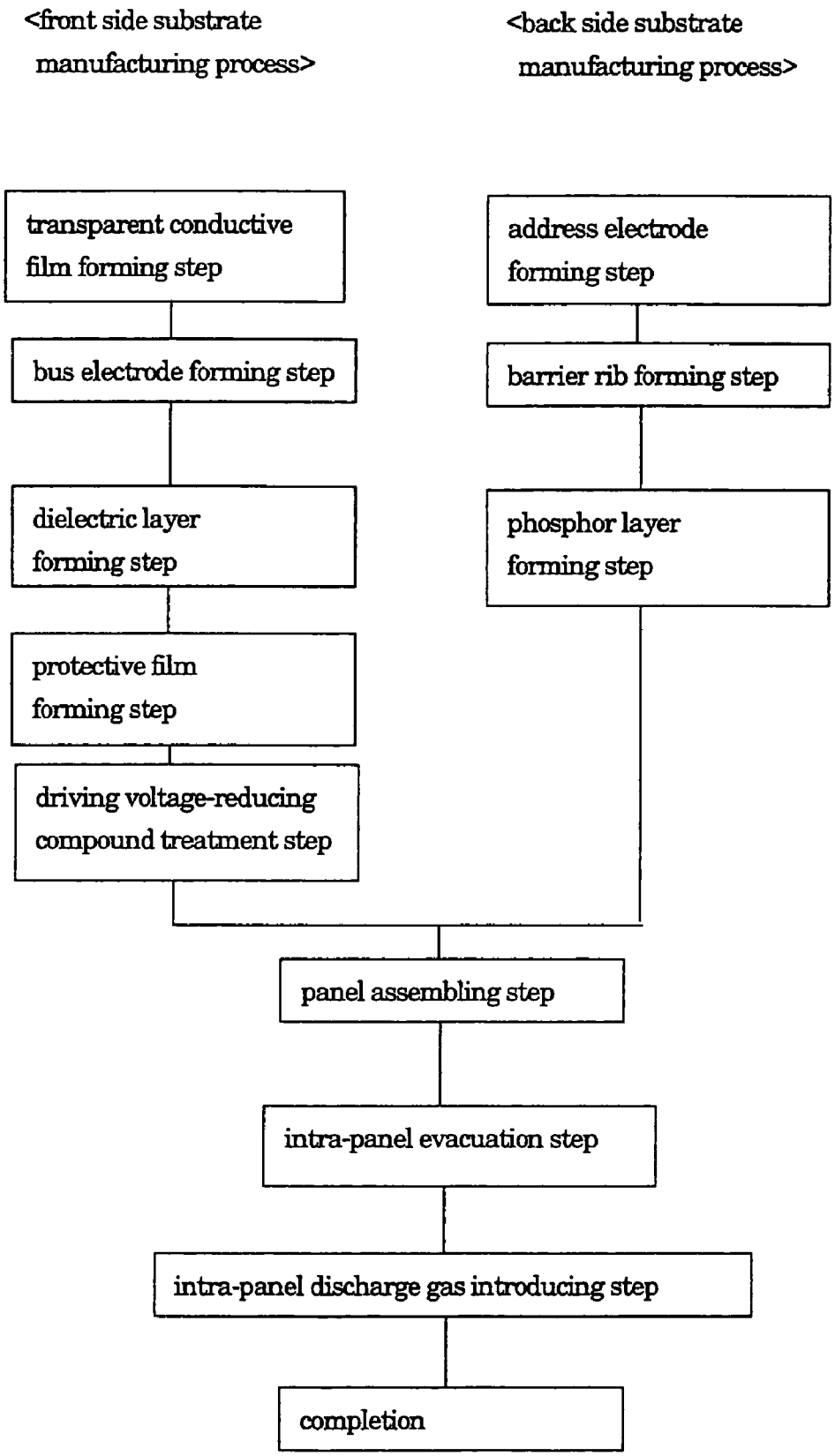
FIG. 3 is a process flow of a PDP of Example 1.

A manufacturing process of a PDP of Example 1 will be explained by using a process flow chart of FIG. 3. FIG. 3 is as same as FIG. 2 which is the conventional process flow chart except that a step of exposing the protective film to the atmosphere of driving voltage-reducing compound is further included and $BaAl_{12}O_{19}$:Mn having high reduction resistance is used as a green phosphor material. In the following, detailed explanation for FIG. 3 will be made.

First, a transparent electrode film 41 in the form of stripe of plural lines is formed on a glass substrate 11 by a known method (transparent conductive film forming step). Next, a bus electrode 42 is formed on the transparent electrode film 41 by a known method (bus electrode forming step). Then a dielectric layer 17 is formed so as to cover the transparent electrode film 41 and the bus electrode 42 by a known method (dielectric layer forming step). Thereafter, a protective film 18 formed of MgO exposed to a discharge space is formed on the dielectric layer 17 by a known method (protective film forming step).

Next, the protective film 18 is passed through an atmosphere of 1-propanol vapor to let 1-propanol be contained in the protective film 18 (driving voltage-reducing compound treatment step). As a result of this, a front side substrate is obtained.

Next, a plurality of address electrodes A in the form of stripe are formed on a glass substrate 21 by a known method (address electrode forming step). Then a plurality of barrier ribs 29 in the form of stripe are formed between neighboring address electrodes on the glass substrate 21 by a known method (barrier rib forming step). Further, a phosphor layer 28 is formed between barrier ribs 29 by a known method (phosphor layer forming step). As a result of this, a back side substrate is obtained.

The front side substrate and the back side substrate are brought into opposite with each other with their inner faces opposing so that the display electrode and the address electrode intersect at right angles, and the periphery of the substrates is sealed with a sealing member to thereby assemble a panel (panel assembling step). Next, heat is applied for exhausting impure gas existing in the interior space of panel (intra-panel evacuation step). Then the cleaned space of the panel is filled with a discharge gas (for example, Ne(96%)-Xe(4%) gas) (intra-panel discharge gas introducing step), to thereby form the PDP 100.

The driving voltage for the PDP thus obtained can be reduced by about 10 V compared to the PDP in which the protective film is not treated with 1-propanol.

Example 2

Figure 4:
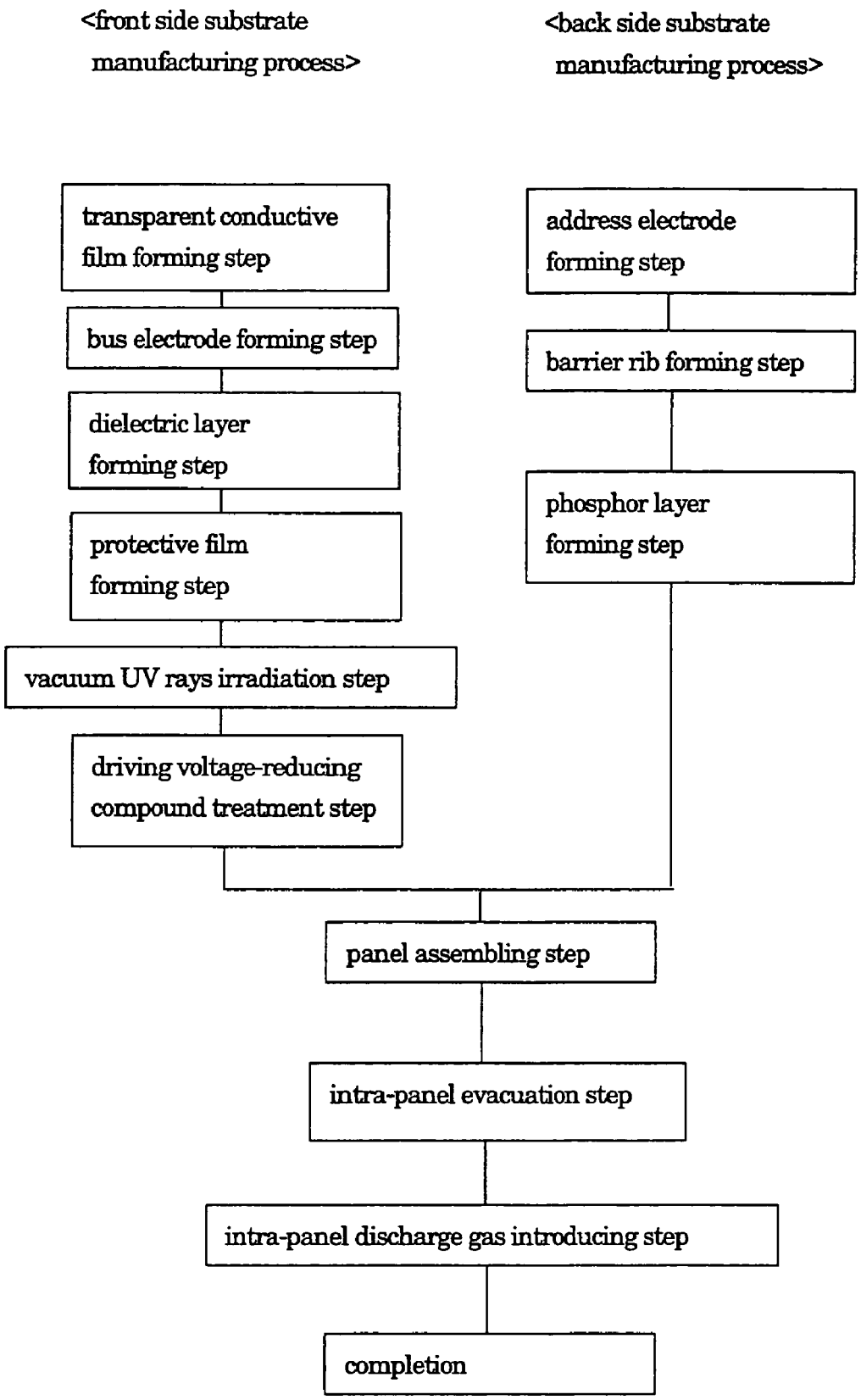
FIG. 4 is a process flow of a PDP of Example 2.

A manufacturing process of a PDP of Example 2 will be explained by using a process flow chart of FIG. 4. FIG. 4 is as same as FIG. 3 which is the process flow chart of Example 1 except that a step of irradiating the protective film with vacuum UV rays is further included and diethylene glycol monobutyl ether acetate is used as the driving voltage-reducing compound.

As the vacuum UV rays, Xe molecule rays of 172 nm with an energy of 10 mW/cm$^2$ are emitted for 5 minutes (vacuum UV rays irradiation step). This irradiation allows $CO_2$ to be removed from $MgCO_3$ formed on the surface of MgO, so that it is possible to improve the activity on the MgO surface.

The driving voltage for the PDP thus obtained can be reduced by about 10 V compared to the PDP in which the protective film is not treated with diethylene glycol monobutyl ether acetate.

Example 3

Figure 5:
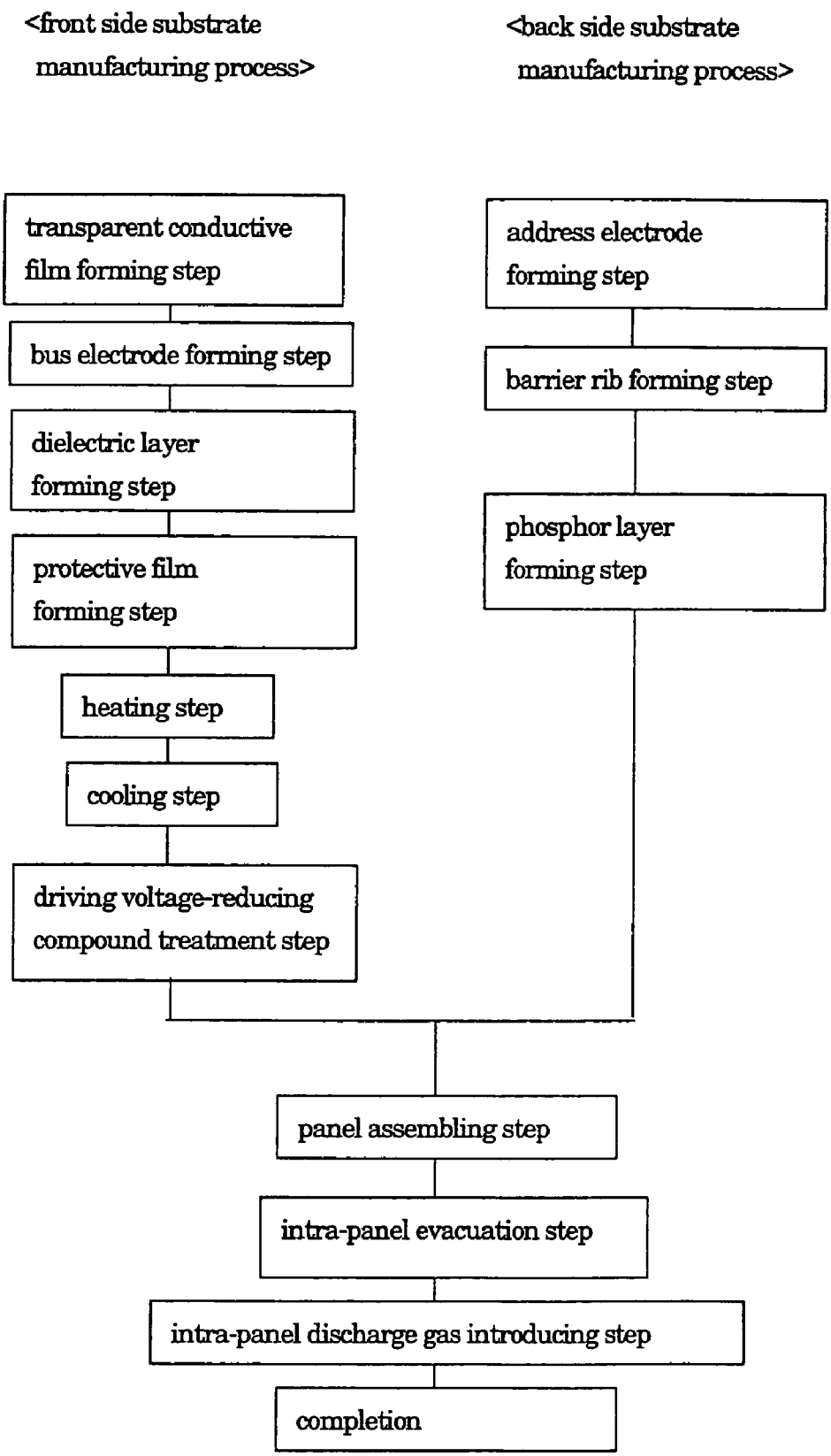
FIG. 5 is a process flow of a PDP of Example 3.

A manufacturing process of a PDP of Example 3 will be explained by using a process flow chart of FIG. 5. FIG. 5 is as same as FIG. 3 which is the process flow chart of Example 1 except that a step of heating the protective film and a step of cooling the same to room temperature are further included, methane gas is used as the driving voltage-reducing compound, and the protective film is exposed to an atmosphere of methane gas in airtight state (driving voltage-reducing compound treatment step).

Heating of the protective film was continued at 300° C. for 30 minutes (heating step), and cooling of the protective film was conducted by lowering the temperature to room temperature (about 25° C.) by letting it stand for 60 minutes (cooling step). Since $CO_2$ can be removed from $MgCO_3$ formed on the surface of MgO by the heating step, it is possible to improve the activity on the MgO surface.

The driving voltage for the PDP thus obtained can be reduced by about 10 V compared to the PDP in which the protective film is not treated with methane.

According to the present invention, it is possible to reduce the driving voltage compared to the conventional gas discharge panel having a protective film not containing the drive voltage-reducing compound. Accordingly, it is possible to provide a gas discharge panel of low power consumption and less generation of electromagnetic wave. Moreover, since the necessity of using an expensive, high pressure resistant driving circuit device is eliminated it is possible to provide a low-priced display device.

What is claimed is:

1. A method of producing a gas discharge panel comprising:

forming a protective film containing a driving voltage-reducing compound by exposing a protective film to an atmosphere of driving voltage-reducing compound directly after forming the protective film, wherein the protective film is a MgO film, and the MgO film is exposed to a vapor atmosphere of compound selected from 1-propanol, diethylene glycol monobutyl ether acetate, methane, α-terpineol and 1-butanol after forming the MgO film.

2. A method of producing a gas discharge panel comprising:

exposing a protective film to an atmosphere of driving voltage-reducing compound after irradiating the protective film with vacuum UV rays, thereby forming a protective film containing a driving voltage-reducing compound, wherein the protective film is a MgO film, and the MgO film is exposed to a vapor atmosphere of compound selected from 1-propanol, diethylene glycol monobutyl ether acetate, methane, α-terpineol and 1-butanol after forming the MgO film.

3. A method of producing a gas discharge panel comprising:

heating a protective film to 300° C. or more, cooling the same to atmospheric temperature, and then exposing the protective film to an atmosphere of driving voltage-reducing compound, thereby forming a protective film containing a driving voltage-reducing compound, wherein the protective film is a MgO film, and the MgO film is exposed to a vapor atmosphere of compound selected from 1-propanol, diethylene glycol monobutyl ether acetate methane, α-terpineol and 1-butanol after forming the MgO film.

* * * * *

UNITED STATES PATENT AND TRADEMARK OFFICE

CERTIFICATE OF CORRECTION

PATENT NO. : 7,458,871 B2
APPLICATION NO. : 11/257109
DATED : December 2, 2008
INVENTOR(S) : Tadayoshi Kosaka et al.

It is certified that error appears in the above-identified patent and that said Letters Patent is hereby corrected as shown below:

Column 8, Line 35, after “acetate” insert --,--.

Signed and Sealed this

Seventeenth Day of February, 2009

JOHN DOLL
*Acting Director of the United States Patent and Trademark Office*